United States Patent [19]

Martyak

[11] Patent Number: 4,927,506

[45] Date of Patent: May 22, 1990

[54] HIGH-PERFORMANCE ELECTRODEPOSITED CHROMIUM LAYERS FORMED AT HIGH CURRENT EFFICIENCIES

[75] Inventor: Nicholas M. Martyak, Hazlet, N.J.

[73] Assignee: Atochem North America, Inc., Somerville, N.J.

[21] Appl. No.: 407,174

[22] Filed: Sep. 14, 1989

[51] Int. Cl.[5] ..... C25D 3/04

[52] U.S. Cl. ..... 204/51; 204/43.1

[58] Field of Search ..... 204/51, 43.1

[56] References Cited

U.S. PATENT DOCUMENTS 3,758,390 9/1973 Chessin et al. ..... 204/51
3,804,728 4/1974 Chessin et al. ..... 204/51
4,472,249 9/1984 Chessin ..... 204/51
4,828,656 5/1989 Korbach et al. ..... 204/43.1
4,836,897 6/1989 Korbach et al. ..... 204/51

*Primary Examiner*—G. L. Kaplan
*Attorney, Agent, or Firm*—S. A. Marcus; R. B. Henn

[57] ABSTRACT

Novel chromium plating baths suitable for electrodepositing chromium layers which are bright, adherent, smooth and hard, and are capable of being formed at both high and low current densities, and at high cathodic current efficiencies, consist essentially of chromic acid and sulfoacetic acid in a concentration range of about 40 to 150 g/l., and selenate or tellurate ion. Sulfate ion, if present, is included in low concentrations such that the $Cr/SO_4$ ratio is high, preferably 300:1 or more.

16 Claims, No Drawings

HIGH-PERFORMANCE ELECTRODEPOSITED CHROMIUM LAYERS FORMED AT HIGH CURRENT EFFICIENCIES

BACKGROUND OF THE INVENTION

1. Field of the Invention

This invention relates to functional electrodeposited chromium layers having advantageous performance properties, and to a chromium plating bath and method for forming such chromium electrodeposits at high efficiencies.

2. Description of the Prior Art

Hexavalent chromium plating baths are described in U.S. Pat. Nos. 3,654,101 to Aoun, and 3,745,097, 4,450,050, 4,472,249 and 4,588,481 to Chessin et al. These baths generally are intended for decorative chromium plating or for hard, functional, chromium electrodeposition. Decorative chromium plating baths are concerned with deposition over a wide plating range, so that articles of irregular shape can be completely covered; functional chromium plating, on the other hand, is generally designed for regularly shaped articles, where plating at higher current efficiency and at higher current densities is important.

Functional hexavalent chromium-plating baths containing chromic acid and sulfate as a catalyst generally permit the deposition of chromium on a basis-metal substrate at cathode efficiencies of about 12% to 16% at current densities of from about 15 to about 95 amperes per square decimeter (asd), current efficiency being defined as the ratio of the amount of current used to achieve plating to the amount of current applied to the bath. Mixed-catalyst chromic-acid plating baths containing both sulfate and fluoride ions generally allow chromium plating at higher cathode efficiencies, e.g., from 22 to over 26%. However, the presence of fluoride ion in such baths causes etching of the generally ferrous-based metal substrate.

Other chromium plating baths which use iodide, bromide or chloride ions as additives can operate at even higher current efficiencies, but such baths produce chromium deposits which do not adhere well to the substrate, and which are dull in appearance, or at best only semi-bright. For example, Chessin, in U.S. Pat. No. 4,472,249, describes a high-energy-efficient functional chromium electroplating bath which operates at very high current efficiencies, e.g., about 50%. These baths generally consist of chromic acid, sulfate ion, iodide and a carboxylate, and are used at conventional current densities between about 15 and about 95 asd. Unfortunately, this bath has adherence problems and poor low-current-density etching, and provides only a semi-bright deposit.

Chessin and Newby, in U.S. Pat. No. 4,588,481, describe a method for producing non-iridescent, adherent, bright chromium deposits at high current efficiencies, without low-current-density etching. This method involves plating at a temperature of from about 45 to about 70 degrees Centigrade (°C.) from a functional chromium plating bath consisting essentially of chromic acid and sulfate ion, and a non-substituted alkyl sulfonic acid having a ratio of sulfur to carbon of more than ⅓, the bath being substantially free of carboxylic or dicarboxylic acid.

Suzuki and Tsukakoshi, in U.S. Pat. No. 4,543,172 and 4,592,819, describe a very-high-speed apparatus for electroplating metals, e.g., chromium, within a very short time period. In this method, a flowing plating liquid is circulated at a high speed between a workpiece and an anode in the plating chamber. The operating current densities permissible in such a system can range from 775 to 1400 asd, which is an extraordinarily high current density, but which enables plating to occur very rapidly. In fact, the apparatus is referred to in the art as a "Rapid Plating System" (RPS). Unfortunately, the demands of this system necessitate a chromium-plating bath which can operate under the extreme RPS conditions in order to provide higher-performance chromium electrodeposits.

Accordingly, it is an object of the present invention to provide a high-performance electrodeposited chromium layer, a chromium-plating bath, and a method for forming such chromium electrodeposits, particularly under RPS conditions.

A specific object herein is to provide chromium electrodeposits which are adherent, bright, smooth, hard, wear resistant, exhibit a low coefficient of friction, and which can be formed at high efficiencies and at useful current densities, including both the very high operating-current densities of rapid plating systems, and the low current densities of conventional chromium plating.

SUMMARY OF THE INVENTION

The chromium-plating bath of the present invention consists essentially of chromic acid, sulfoacetic acid, in a concentration range of from about 40 to about 150 grams per liter (g/l), and selenate ion or tellurate ion, or both. Sulfate, if present, is included in low concentrations such that the $Cr/SO_4$ ratio is high, preferably 300:1 or more.

The plating bath of this invention is further characterized by being substantially free of deleterious carboxylic acids, alkylsulfonic acids, and fluoride, bromide, iodide and phosphate ion.

The plating process of the invention can be carried out at conventional low current densities, e.g. from about 15 to about 95 asd. However, the plating bath herein also can be operated under rapid plating conditions, i.e. at very high current densities in the range of from about 775 to about 1400 asd, at which current densities deposition can occur within seconds rather than the minutes required at conventional plating-current densities.

DESCRIPTION OF THE PREFERRED EMBODIMENTS

As shown in Table I hereinbelow, a typical functional chromium electroplating bath in accordance with the invention has the following constituents present in g/l. of plating solution.

TABLE I

| Constituent | Suitable | Preferred |
|---|---|---|
| Chromic acid | 150–450 | 200–350 |
| Sulfoacetic acid* | 40–150 | 80–120 |
| Selenate** and/or Tellurate** | 0.1–1.0 | 0.4–0.8 |
| Optional Constituent | | |
| Sulfate ion | 0–1.5 | |
| $Cr/SO_4$ ratio | >300:1 | |
| Operating Conditions | | |
| Rapid Plating (by the method described in U.S. Pat. No. 4,543,172 | | |
| Current density (asd) | 775–1400 | 1100–1250 |
| Temperature (°C.) | 50–70 | 55–60 |
| Conventional Plating | | |

TABLE I-continued

| Constituent | Suitable | Preferred |
|---|---|---|
| Current density (asd) | 15–160 | 15–60 |
| Temperature (°C.) | 45–70 | 50–60 |

*Sulfoacetic acid can be present also as sulfoacetate, isethionic acid or an isethionate, which compounds are added to the plating bath to provide sulfoacetic acid in the desired concentration.

**Selenium is added as sodium selenate; tellurium is added as telluric acid.

The current efficiencies obtained by using the plating-bath composition of the invention are shown in Table II, below, for different plating conditions.

TABLE II

| Plating Condition | Plating Efficiency |
|---|---|
| High Current Densities | 80% |
| Conventional Low Current Densities | 35% |

A typical chromium electrodeposit formed on a basis metal, e.g. steel, from the electroplating bath of the invention, under the conditions described above, showed excellent adhesion to the substrate, with a smooth surface and excellent brightness. In rapid plating, the thickness of the plated material was from about 0.0025 to about 0.13 millimeters (mm). When using conventional plating, the thickness was about 0.0025 mm. The hardness, expressed in Knoop Hardness Units ($KHN_{100}$) was from about 1100 to about 1400; the wear resistance and coefficient of friction were both rated as excellent.

The invention will be described in more detail hereinafter with reference to the following examples.

LOW-CURRENT-DENSITY PLATING

EXAMPLE 1

A chromium-electroplating bath was prepared having the following composition, concentrations being expressed in g/l.

Chromic Acid: 250
Sulfoacetic acid: 100
Sodium Selenate: 0.5

Chromium was plated from the foregoing bath onto a steel mandrel at 78 asd, at 57° C. for 20 minutes (min.), to produce a chromium layer thereon having a thickness of 0.025 mm. The current efficiency was 31%. The chromium electrodeposit had the physical and performance properties given in Table II above at a $KHN_{100}$ of 1325.

EXAMPLE 2

A chromium electroplating bath having the following composition in g/l. was prepared.

Chromic Acid: 250
Sulfoacetic acid: 80
Sodium Selenate: 0.4
Sulfate: 0.42

Chromium was plated from the bath described above onto a steel mandrel at 47 asd and 57° C. for 30 min. to produce a chromium layer thereon having a thickness of 0.038 mm. The current efficiency was 28%.

The chromium electrodeposit had the physical and performance properties given in Table II above at $KHN_{100}$ of 1350.

EXAMPLE 3

The chromium-plating bath had the following composition in g/l.:

Chromic acid: 250
Sulfoacetic acid: 100
Sodium Selenate: 0.5
Telluric acid: 0.8

Chromium was plated onto a steel mandrel at 78 asd at 57° C. for 30 min. to produce a chromium layer having a thickness of 0.041 mm. The current efficiency was 32%. The physical properties and chemical composition of the chromium electrodeposit were similar to those given in Table II above. The hardness value $KHN_{100}$ was 1350.

HIGH-CURRENT-DENSITY PLATING (RAPID-PLATING CONDITIONS)

EXAMPLE 4

The chromium electroplating baths of Examples 1–3 were used in this example. The solution was circulated at a pump speed of five cubic meters per hour between a steel shock workpiece and a platinized titanium anode at 60° C., in the apparatus described in U.S. Pat. No. 4,543,172. The high-speed flow of plating solution made the ion-diffusion layer in the area around the workpiece thinner, allowing a large current flow at between 14 and 20 volts. The current density was 1400 asd. After 20 seconds of plating, a chromium deposit of 0.018 mm. was obtained at a current efficiency of 80%. The chromium deposit had substantially the properties given in Table II above, the hardness value $KHN_{100}$ being 1250.

Modifications, changes and improvements to the preferred forms of the invention herein described, disclosed and illustrated may occur to those skilled in the art who come to understand the principles and precepts thereof. Accordingly, the scope of the patent to be issued hereon should not be limited to the particular embodiments of the invention set forth herein, but rather should be limited only by the advance by which the invention has promoted the art.

What is claimed is:

1. A functional chromium plating bath consisting essentially of chromic acid, from about 40 to about 150 g/l. of sulfoacetic acid, said bath being substantially free of other carboxylic acids, and substantially free of fluoride ion, chloride ion and phosphate ion, and further having selenate or tellurate ions in the bath, present in the amount of from about 0.1 to about 1.0 g/l. each.

2. The bath of claim 1 wherein chromic acid is present in an amount of from about 150 to 450 g/l.

3. The bath of claim 1 wherein sulfoacetic acid is present in an amount of from about 80 to about 120 g/l.

4. The bath of claim 1 wherein said bath further includes sulfate ion in an amount up to about 1.5 g/l.

5. The bath of claim 4 wherein the ratio of chromic acid to sulfate ion is at least about 300:1.

6. The bath of claim 1 having from about 150 to about 450 g/l chromic acid, about 40 to about 150 g/l sulfoacetic acid, from about 0.1 to about 1 g/l. selenate ion, and from about zero to about 1.5 g/l. sulfate ion.

7. A process for electroplating a functional chromium layer onto a basis metal, which comprises electrodeposition from the electroplating bath of claim 1.

8. The process of claim 7 wherein said bath also includes sulfate ion in an amount up to about 1.5 g/l.

9. The process of claim 8 wherein the ratio of chromic acid to sulfate ion is at least 300:1.

10. The process of claim 7 wheein sulfoacetic acid is present in an amount of from about 80 to about 120 g/l.

11. The process of claim 7 wherein chromic acid is present in an amount of from about 200 to about 300 g/l.

12. The process of claim 7 wherein said electrodeposition is carried out at a temperature of from about 50° to about 70° C.

13. The process of claim 7 wherein the current density is from about 775 to about 1400 asd.

14. The process of claim 7 wherein the thickness of said chromium layer is from about 0.0025 to about 0.5 mm.

15. The process of claim 7 wherein the current density is from about 14 to about 160 asd.

16. The process of claim 15 wherein the thickness of said chromium layer is at least 0.0025 mm.

* * * * *